United States Patent [19]

Welp et al.

[11] 4,121,236

[45] Oct. 17, 1978

[54] APERTURE CARD CAMERA WITH DEVICE FOR SPRAYING THE EXPOSED FILM

[75] Inventors: Ulrich Welp; Gero Sellien, both of Bad Nauheim, Fed. Rep. of Germany

[73] Assignee: Microbox Dr. Welp GmbH & Co., Bad Nauheim, Fed. Rep. of Germany

[21] Appl. No.: 700,388

[22] Filed: Jun. 28, 1976

[30] Foreign Application Priority Data

Jul. 4, 1975 [AT] Austria ..... 5190/75
Apr. 15, 1976 [AT] Austria ..... 2816/76

[51] Int. Cl.[2] ..... G03D 3/06
[52] U.S. Cl. ..... 354/323; 354/317; 354/325; 417/395
[58] Field of Search ..... 354/83, 88, 317, 323, 354/325; 417/392, 394, 395

[56] References Cited

U.S. PATENT DOCUMENTS

| | | | |
|---|---|---|---|
| 2,619,907 | 12/1952 | Paterson | 417/395 |
| 2,635,545 | 4/1953 | Wood | 417/395 |
| 2,922,352 | 1/1960 | Tuttle | 354/317 |
| 2,981,170 | 4/1961 | Brault | 354/317 |
| 3,027,821 | 4/1962 | Wright | 354/317 |
| 3,143,943 | 8/1964 | Townley et al. | 354/317 |
| 3,149,550 | 9/1964 | Lohse et al. | 354/323 |
| 3,194,170 | 7/1965 | Ulbing | 417/394 |

*Primary Examiner*—L. T. Hix
*Assistant Examiner*—Alan Mathews
*Attorney, Agent, or Firm*—W. G. Fasse; W. W. Roberts

[57] ABSTRACT

An aperture card camera is provided with a spraying device for supplying to the exposed film a liquid such as a developer or the like. The liquid is sucked from an open supply container which is under atmospheric pressure. The liquid is then delivered to the developing chamber by a double action membrane pump. The membrane pump may comprise membranes which function as pump membranes and as valve membranes.

9 Claims, 5 Drawing Figures

APERTURE CARD CAMERA WITH DEVICE FOR SPRAYING THE EXPOSED FILM

BACKGROUND OF THE INVENTION

This invention concerns an aperture card camera with a device for spraying the exposed film under pressure with developer, fixer, and water or with developer-fixer and water.

The film is mounted in the aperture card. To produce a sufficiently fine mist, the processing fluids are sprayed through a nozzle under high pressure at about 3–7 atmospheres gauge.

In prior art aperture card cameras, this purpose has been achieved by maintaining the entire fluid system under pressure by means of a compressor. The fluid system includes, in addition the pipe conduits, two or three containers for the processing fluids.

Various governmental safety standards must be satisfied by these containers and pipes, among these standards is the use of special, expensive construction materials for the containers and pipes, and an expensive method of constructing the entire pressure system. The chemicals needed for the processing fluids involve very corrosive materials.

The fluid containers must be refilled from time to time. Not all containers are refilled at the same time, but rather at different time intervals, since the consumption of the respective processing fluids varies.

For each refill, the entire fluid system must be depressurized and after the refilling of the empty container or containers - each of which holds between 1 and 2.0 liters fluid - the system must be pressurized to the operating pressure. To this end an appropriately high-performance and hence expensive compressor is provided in most prior art aperture card cameras. The type of fluid system here involved excludes the use of larger containers for technical and economic reasons, especially because the pressure on the total container area rises with the size of the container.

SUMMARY OF THE INVENTION

The invention aims to eliminate the disadvantages of the above mentioned aperture card cameras.

The purpose of the invention has been achieved in an aperture card camera by outfitting the pressure spray device with a pump which sucks the processing fluids from containers at atmospheric pressure and delivers these fluids to the present spray assembly under the desired pressure.

According to another feature of the invention, the present pump is an improved differential pressure membrane pump.

In a preferred embodiment, the present pump comprises two cover pieces, a cylinder, two membranes fastened between the cover pieces and the cylinder, and a differential piston which is controlled by the membrane, whereby pressure piping for the membrane is controlled by a magnetic valve, and wherein a return valve is arranged for the processing of the fluids in the suction or pressure pipes which are attached to the cylinder.

In a second embodiment, the differential pressure membrane pump comprises two cover discs, an intermediate disc and two membranes fastened between the cover discs and the intermediate disc, whereby two membrane valves are provided between one cover disc and the intermediate disc and a membrane pump space is provided between the intermediate disc and the other cover disc. This second pump embodiment functions without differential pistons.

An especially advantageous embodiment results if, as in the invention, the pressure spray device is equipped with a pumpblock of two or three such pumps.

By means of the construction of the aperture card camera according to the invention, the disadvantages of currently known models are avoided. In particular, the costly fluid-pressure system and the earlier inevitable loss of time needed for refilling the fluids have been avoided.

BRIEF FIGURE DESCRIPTION

In order that the invention may be clearly understood, it will now be described, by way of example, with reference to the accompanying drawings, wherein.

DETAILED DESCRIPTION OF PREFERRED EXAMPLE EMBODIMENTS

Figure 1:
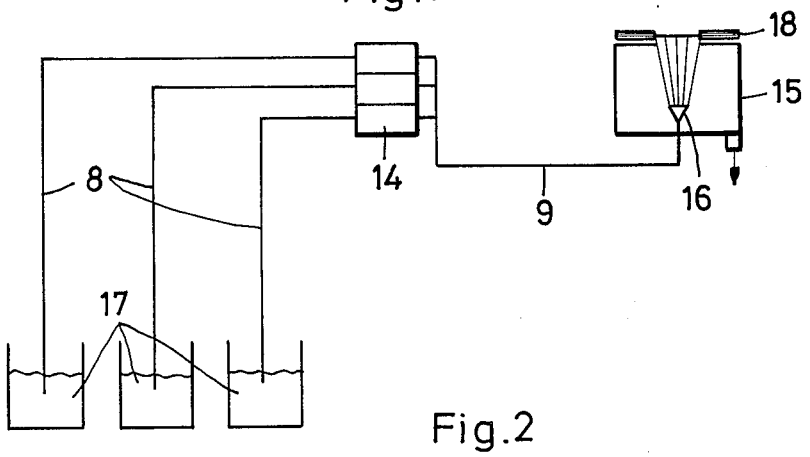
FIG. 1 shows schematically a pump system and developing chamber of the invention.

Referring to FIG. 1, a pump 14 is provided right in front of the nozzle or nozzles 16 in the developing chamber 15 of the camera.

This pump sucks developer, fixer, and water, or fixer-developer and water, from the fluid containers 17, brings these processing fluids to the desired pressure and, controlled by a valve, delivers the needed respective fluid to nozzle 16.

Figure 2:
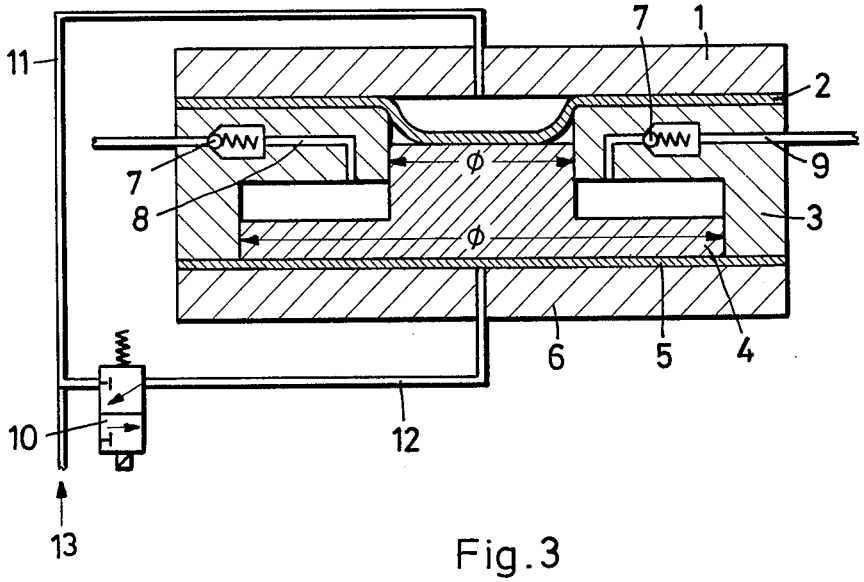
FIG. 2 shows a sectional view through one embodiment of a membrane pump of the invention with the pump piston at the end of a suction stroke.
Figure 3:
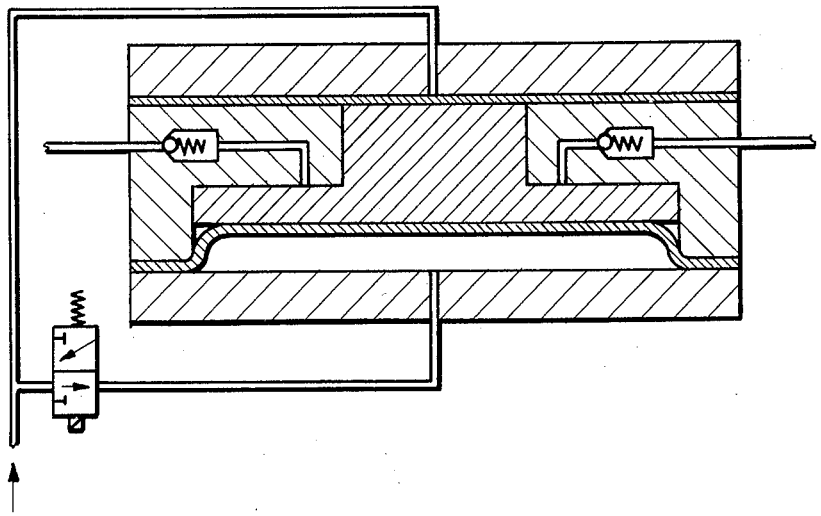
FIG. 3 shows the same sectional view as FIG. 2, but with the piston at the end of a pressure stroke.

Referring to FIGS. 2 and 3, the pump comprises two cover pieces 1 and 6, two membranes 2 and 5, a cylinder 3, and a differential piston 4, whereby the membranes are suitably fastened between the pump cylinder and the respective cover pieces.

A vacuum pipe 8 and a pressure pipe 9 are arranged in the pump for the processing fluids.

A check valve 7 is arranged in each of these two pipes 8 and 9. The pump is controlled by pressurized oil indicated by the arrow 13 and by electromagnetic valve 10.

The pump of the invention operates as follows:

The pressurized oil 13 is effective on the membrane 2 through a pipe 11 which presses the differential piston 4 down. At the same time, the pump sucks fluid from container 17 through suction pipe 8 and check valve 7.

If the control pressure is switched over magnetic valve 10 to the pressure pipe 12 it becomes effective on membrane 5, whereby the membrane 5 presses the differential piston 4 up with a strength which is determined by the reduction of the effective pressure surface area of membrane 5 by the effective pressure area of membrane 2.

The processing fluid is controlled by the check valves 7, in that on a suction stroke one check valve 7 closes the pressure pipe 9 and on a pressure stroke, the other check valve 7 closes the suction pipe 8. In the second embodiment shown in FIGS. 4 and 5, the pump comprises two cover discs 31 and 36, two membranes 32 35 and intermediate plate 33.

The membranes 32 35 are clamped between the intermediate plate 33 and the respective cover discs 31 36.

For forming the membrane pump space 34, the intermediate plate 33 and cover plate 36 are provided with appropriate cavities 37, 38.

Furthermore two membrane-valves 42 and 43 are arranged in the pump. One surface of membrane-valve 42 is connected to a pressure control pipe 44 and membrane-valve 43 is connected to a vacuum control pipe 45.

The flow of pressure fluid through valve 44 is controlled by a magnetic valve 46 and the flow of fluid through pipe 45 is controlled by a magnetic valve 47.

The other surface of the membrane 32 which forms the membrane-valve 42 faces a pressure pipe 9, which leads to the development chamber 15 of the camera, and a second pipe 48 connected to the membrane pump space 34.

The membrane valve 43 formed by the membrane 32 is operatively connected to the membrane pump space 34 by a conduit 49.

In addition, the membrane valve 43 is operatively connected to a vaccum tube 8, leading to the containers 17 which are at atmospheric pressure.

The vacuum control pipe 45 below the magnetic valve 47 extends through the pump cover 31 and is connected by means of pipe 51 to the cavity 38 below the membrane 35, that is below the membrane surface facing cover disc 36.

The pressure control pipe 44 is connected to magnetic valve 47 be means of tube 52 in such a fashion, that by proper adjustment of the magnetic valve 47, FIG. 3, the pipes 51 and thus cavity 38 may be pressurized. A pressure reduction valve 53 may be inserted in pipe 51.

The pump is operated by the pressure in the control pipe 44. Such pressure may be equal to the spray pressure or it may be higher and if necessary it may be reduced by the pressure reduction valve 53.

Figure 4:
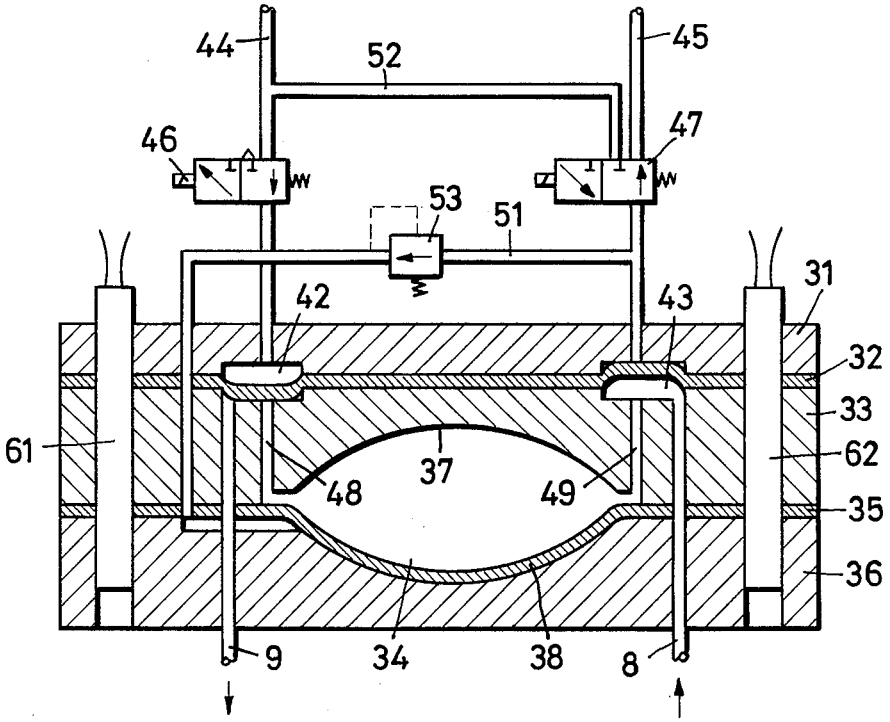
FIG. 4 illustrates a sectional view similar to that of FIGS. 2 and 3, however, showing a modification of the invention wherein the pump action is accomplished by a membrane piston at the end of its suction stroke.
Figure 5:
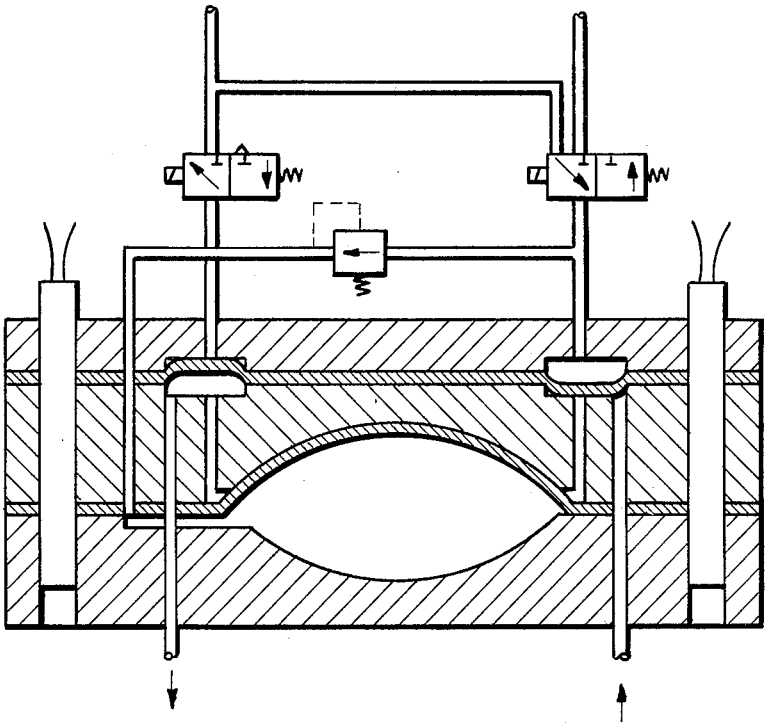
FIG. 5 shows the pump of FIG. 4 at the end of the pressure stroke of the membrane piston.

The pump is also driven by vacuum control pipe 45. The control is achieved by means of electromagnetic valves 46 and 47. The embodiment of the invention shown in FIGS. 4 and 5 is as follows:

Pressure in pipe 44 is effective through the magnetic valve 46 on the membrane valve 42 and closes it FIG. 4.

The vacuum control pipe 45 is effective through magnetic valve 47 to open the membrane valve 43 and connect suction pipe 8 to the pump chamber 34 (FIG. 4).

Simultaneously, the vacuum operates through pipe 51 on the control side of the pump membrane 35 and sucks it down whereby fluid is drawn through suction pipe 8 into the pump chamber 34.

By switching the magnetic valve 47, control pressure 44 closes membrane valve 43 and the suction pipe 8 whereby the pump chamber 34 is subjected to the spray pressure through pipe 51 (FIG. 5).

Upon switching magnetic valve 46, the membrane valve 42 opens (FIG. 5) and the fluid is squeezed out of the pump chamber 34 through the pressure pipe 9.

Restoration of magnetic the valves 46 and 47 to their starting position (FIG. 2) closes valve 42 and opens valve 43 whereby the pump resumes the suction phase of its operating cycle.

In addition, the pump may be heated by inserting heating elements 61 and 62.

Two or three differential pressure membrane pumps may be arranged for the pressure spraying device 16, as a pump block 14, see FIG. 1.

The invention is not limited to aperture card cameras but may be used also for microfilm cameras, for example. Thus, although the invention has been described with reference to specific example embodiments, it is to be understood that it is intended to cover all modifications and equivalents within the scope of the appended claims.

We claim:

1. An apparatus for spraying an exposed film with processing liquid under pressure, said processing liquid including developer, fixer and water or fixer-developer and water, comprising container means for said processing liquid, processing means including a developing chamber and spraying nozzle means in said developing chamber, pump means including constant volume pump chamber means, suction pipe means operatively interconnecting said container means to said constant volume pump chamber means, pressure pipe means operatively connecting said nozzle means to said constant volume pump chamber means for conveying processing liquid under pressure from said container means to said nozzle means, said pump means further comprising first cover plate means, and second cover plate means as well as intermediate pump disc means operatively held in position between said first and second cover plate means to form said constant volume pump chamber means, first membrane means operatively clamped in position between said first cover plate means and said intermediate pump disc means, second membrane means operatively clamped between the intermediate pump disc means and said second cover plate means, pump operating conduit means, and controllable valve means operatively connecting said pump operating conduit means to said pump means for operating the pump means.

2. The apparatus of claim 1, wherein said constant volume pump chamber means are formed in said intermediate pump disc with two chamber sections of different diameters, said pump means further comprising a differential pump piston including two sections with correspondingly different diameters operatively fitting into the respective pump chamber section, said first and second membrane means cooperating with said differential pump piston for operating the latter, and wherein said valve means comprise magnetically operated valve means which connect said pump operating conduit means to said pump chamber sections for actuating said differential piston through said first and second membrane means, said pump means further comprising check valve means operatively inserted in said pressure pipe means and in said suction pipe means.

3. The apparatus of claim 1, wherein said pump is a differential pressure membrane pump, said first membrane means cooperating with said first cover plate means and with said intermediate pump disc means to form two membrane valves, and wherein said second membrane means cooperates with said second cover plate means and with said intermediate pump disc means to operate as a pumping membrane in said pump chamber means.

4. The apparatus of claim 3, wherein said pump operating conduit means comprise a pressure conduit (44) and a suction conduit (45) and wherein said controllable valve means comprise a first magnetically operable valve, connecting one of said membrane valves to said pressure conduit, and a second magnetically operable valve connecting the other membrane valve to said suction conduit or to said pressure conduit.

5. The apparatus of claim 4, wherein both membrane valves are operatively connected to said pump chamber means, one membrane valve connecting said pump chamber means through said pressure pipe means to said spraying nozzle means in said developing chamber means, whereas the other membrane valve connects said pump chamber means through said suction pipe means to said container means.

6. The apparatus of claim 4, further comprising conduit means (51) connecting said second magetically operable valve also to said pump membrane on its side facing said second cover plate means.

7. The apparatus of claim 4, further comprising pipe means connecting said second magnetically operable valve to said pressure conduit means.

8. The apparatus of claim 1, further comprising heating elements operatively inserted into said pump means for heating the pump means.

9. The apparatus of claim 1, wherein a plurality of said pump means are combined in a common pump block.

* * * * *